United States Patent [19]

Cox

[11] Patent Number: 4,503,770

[45] Date of Patent: Mar. 12, 1985

[54] PRINTING MACHINE DOCTOR BLADES

[76] Inventor: Norman V. Cox, 43 W. Valley Rd., Hemel, Hempstead, Hertfordshire, England

[21] Appl. No.: 491,204

[22] PCT Filed: Aug. 13, 1982

[86] PCT No.: PCT/GB82/00253

§ 371 Date: Apr. 18, 1983

§ 102(e) Date: Apr. 18, 1983

[87] PCT Pub. No.: WO83/00656

PCT Pub. Date: Mar. 3, 1983

[30] Foreign Application Priority Data

Aug. 18, 1981 [GB] United Kingdom ..... 8125242
Feb. 24, 1982 [GB] United Kingdom ..... 8205461

[51] Int. Cl.[3] ..... B41F 9/10
[52] U.S. Cl. ..... 101/169; 101/365
[58] Field of Search ..... 101/157, 169, 365, 350, 101/363; 15/256.51; 118/126, 261

[56] References Cited

U.S. PATENT DOCUMENTS

| | | | |
|---|---|---|---|
| 1,981,912 | 11/1934 | Fankboner | 101/169 |
| 2,329,277 | 9/1943 | Lodding | 101/169 X |
| 2,692,554 | 10/1954 | Bamford | 101/157 |
| 2,987,748 | 6/1961 | Scott | 15/256.51 |
| 3,292,201 | 12/1966 | Bedard | 15/256.51 X |
| 3,778,861 | 12/1973 | Goodnow | 15/256.51 |
| 4,192,231 | 3/1980 | Kawakami | 101/169 X |
| 4,241,691 | 12/1980 | Hopfe | 15/256.51 X |

FOREIGN PATENT DOCUMENTS

| | | | |
|---|---|---|---|
| 559200 | 6/1958 | Canada | 15/256.51 |
| 1125950 | 3/1962 | Fed. Rep. of Germany | 101/169 |
| 2538908 | 3/1977 | Fed. Rep. of Germany | 101/169 |
| 572531 | 10/1945 | United Kingdom | 101/169 |
| 825436 | 12/1959 | United Kingdom | 101/169 |
| 2071723 | 9/1981 | United Kingdom | 15/256.51 |

*Primary Examiner*—J. Reed Fisher
*Attorney, Agent, or Firm*—Keil & Weinkauf

[57] ABSTRACT

An assembly for supporting and guiding a doctor blade to be applied against the surface of a rotary printing cylinder in a printing machine. The assembly includes the combination of a backing member which is secured on the edge of the doctor blade which is remote from the surface of the cylinder, the provision of parallel surfaces in the mounting with which the backing member is in sliding contact, and the use of a bag within the mounting and which serves for the application of fluid pressure on the backing member to urge the blade in the direction against the surface of the printing cylinder.

5 Claims, 5 Drawing Figures

PRINTING MACHINE DOCTOR BLADES

Figure 1:
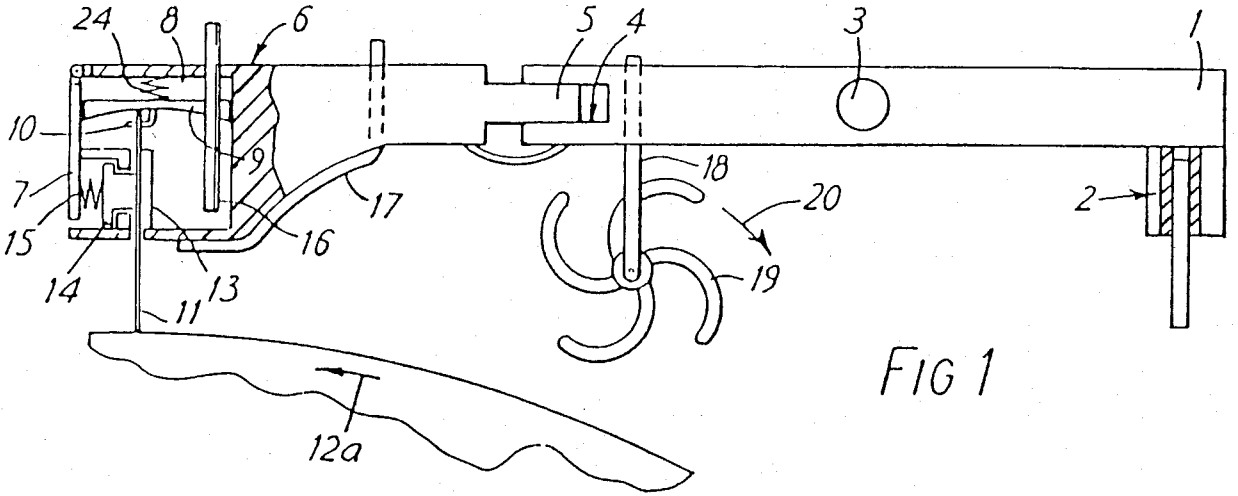

This invention relates to the art of doctor blades for use in printing machines.

In a common form of gravure printing machine, the cylinder having a very large number of ink-holding recesses is wiped, as it rotates, by a doctor blade which is pressed substantially rigidly against the surface of the cylinder.

The object of the present invention is to provide an improved form of doctor blade assembly, and an improved form of doctor blade which:

(i) increase the running life of the doctor blade, (ii) maintain an even pressure between the face of the doctor blade and the cylinder, (iii) prevent foreign bodies becoming trapped between the doctor blades and the cylinder, (iv) counteract, so far as concerns the effect on the doctor blade, the bouncing of the cylinder due to, for example, worn bearings, bent mandrel ends, floating bowl, and rollers, (v) prevent damage to the cylinder, by the doctor blade, as a result of backlash of the cylinder due to general play in the drive gearing of the cylinder, (vi) lower high-pressure build-up of ink buffering against the doctor blade at high speeds, (vii) reduce colour variation between changes of doctor blade.

According to the present invention a doctor blade assembly, for inclusion in a printing machine having a frame structure and a printing cylinder rotatable therein, comprises a mounting for supporting on the frame structure of the machine, a plane doctor blade supported by the mounting so as, when in use, to have its plane radial or at a small angle to radial to the printing cylinder, the doctor blade being movable substantially parallel to its own plane relative to the mounting, and loading means acting between the mounting and the blade in the direction to urge the blade against the printing cylinder.

The mounting may include a hollow housing with the doctor blade extending through an opening in the lower part of said housing to abut against the printing cylinder. In one form to provide for close but movable fitting of the blade, the housing includes elongated support elements between which the doctor blade is sandwiched but relatively slidable, at least one of said supports being resiliently urged towards the other. For example, one of said supports may be a fixed wall of the housing, and the other support may be a pad.

The loading means is preferably resilient loading means, and in a first form the loading means includes spring means acting between the mounting and that edge of the doctor blade which is remote from the printing cylinder. The loading means may thus be a plurality of compression springs disposed at intervals along the length of the doctor blade. A buffer strip may be positioned between such compression springs and the edge of the doctor blade. The doctor blade may conveniently be supported also by suspension means acting between it and the buffer strip. The buffer strip may form a sliding seal with the internal face of the housing such that the portion of the doctor blade which is situated within the housing is within a substantially sealed enclosure which receives any ink which is forced up the upstream surface of the doctor blade during rotation of the printing cylinder. A suction conduit, e.g. a hose protruding into the ink chamber, may serve to remove excess ink.

In another form, the resilient loading means is a bag containing resiliently compressible fluid and having a portion thereof acting on the doctor blade. The bag may, for instance, be disposed within a chamber having elongated legs bounding an opening in which the doctor blade is slidable. In a preferred arrangement, the doctor blade has, on its edge remote from the printing cylinder, a backing member which is abutted by the bag. Said backing member may form a sliding seal with the legs of the chamber.

Conduit means may be provided on the mounting to terminate adjacent the upstream face of the doctor blade for ejection of solvent onto that face, to keep the blade free of hardened ink when a temporary stoppage occurs.

The doctor blade assembly may further comprise sliding joint means by which the mounting may be carried on the frame structure of the printing machine for movement to and fro in a direction which is substantially tangential to the surface of the printing cylinder. Such sliding joint means may comprise, for example, an arm for mounting on the frame structure and including slot means in a free end thereof, and stem means on the mounting engaged in said slot means for reciprocal movement within limits. When the cylinder is running normally the joint is fully extended, but small reverse movements of the cylinder, and thus of the blade, can be accommodated by the sliding joint.

According to a further feature of the invention, the doctor blade is an elongated plane blade having a continuous surface at its edge presented towards the printing cylinder, but having its edge remote from the printing cylinder gapped so as to consist, adjacent that edge, of a plurality of fingers arranged at a spacing from each other.

When a printing machine cylinder of this nature is operating fully, there is very large quantity of ink scraped off its surface by the doctor blade, and this ink tends to build up in a space enclosed by:

(i) the upstream part of the surface of the cylinder, (ii) the doctor blade and its mounting means, and (iii) the support arm on which the doctor blade mounting is carried.

In conventional machines, this surplus ink is allowed to build up to a very great extent, until it falls back by gravity but this is an unsatisfactory procedure as the ink may tend to jam up the movement of the doctor blade and/or of the cylinder itself. To assist in removal of the excess ink from that space, the present invention provides as a further improvement an impeller which is carried by the support means of the doctor blade housing and which is positioned at a spacing somewhat upstream of the doctor blade mounting and in a position where it will be contacted by the ink building up on the cylinder surface. The impeller is intended to thrust any excess ink which lands on it back in the reverse direction, that is to say in the reverse direction to the rotation of the cylinder, so that the space is accordingly kept well clear of too much surplus ink. The impeller may have curved scoop like blades to enhance the effect, and may be self-driven by virtue of impact of the ink on it, or may be separately power driven.

Figure 2:
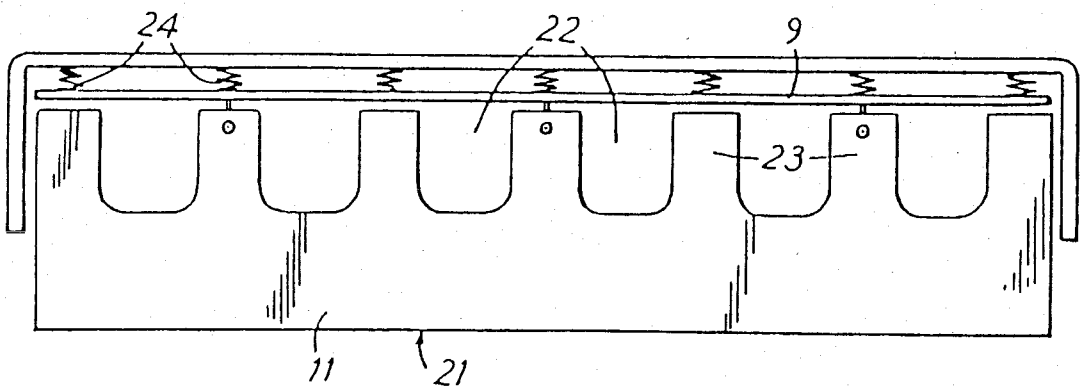
Figure 3:
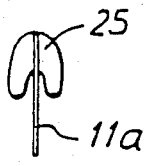
Figure 4:
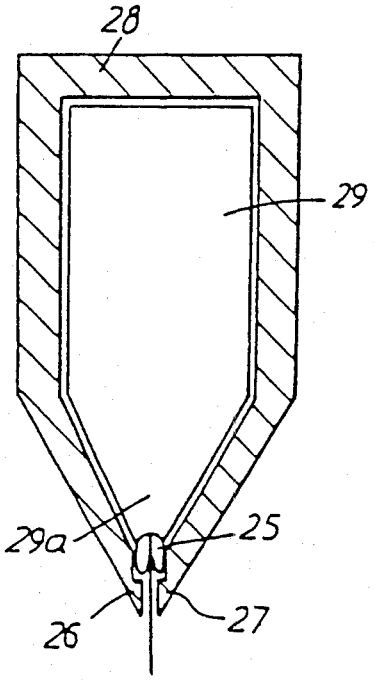
Figure 5:
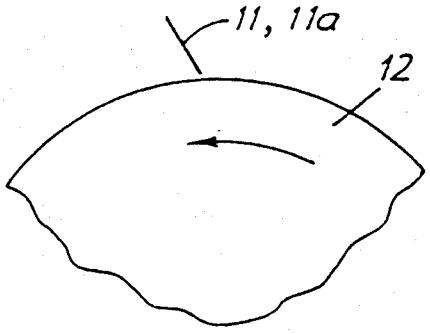

In order that the nature of the invention may be readily ascertained, some embodiments in accordance therewith are hereinafter particularly described with reference to the figures of the accompanying drawings, wherein:

FIG. 1 is a side elevation, with parts shown in section, of a mounting for a doctor blade on a printing machine structure, FIG. 2 is a front elevation of an improved form of doctor blade, FIG. 3 is an end elevation of an alternative construction of doctor blade, FIG. 4 shows an alternative construction of doctor blade and holder therefor and pressing means therefor, which could be inserted in the chamber of the housing shown in FIG. 1, FIG. 5 is a diagram to show how the doctor blade may be inclined against the direction of the printing cylinder, instead of being radial thereto as in FIG. 1.

Referring to FIG. 1, a support arm 1 is adjustable vertically at 2 on the frame of a printing machine structure for raising and lowering the mounting. The arm has the usual traverse pivot 3 about which the arm 1 can rock for setting purpose. At the free end of the arm there is a slot 4 which receives a stem 5 supporting a housing 6. The housing has a hinged front wall 7 which can be opened for access and for blade changing. Within the housing is a chamber 8 in which is received a slidable buffer strip 9 having hooks 10 which are engaged with a doctor blade 11 having its lower edge contacting the surface of a cylinder 12 rotating in the direction of the arrow 12*a*. In the housing is a fixed wall 13 against which the blade rests, and a movable pad 14 is pressed by a spring with tension control 15 to abut against the blade. A suction hose 16 enters the housing space 8 for suction removal of excess ink which may enter along the upstream face of the blade. A conduit 17 is provided for entry of a solvent liquid, from a supply pipe or container (not shown) to maintain the blade clear of hardened ink. The arm 1 carries a support 18 for a rotary impeller 19 designed to throw ink back upstream in the direction of the arrow 20.

Referring now to FIG. 2, the blade 11 has a continuous lower edge 21 for contacting the cylinder surface, but its upper edge is gapped, as at 22 to provide a number of fingers 23, and alternative fingers are coupled by hooks 10 to the buffer strip 9. Adjustable springs 24 with tension control act between the upper wall of the housing 8, and the buffer strip 9, to urge the doctor blade 11 against the cylinder 12. The gaps 22 may have an infill of pliable material to prevent ink seepage.

Upstream of the doctor blade 11, considered in the direction of rotation of the cylinder, there may be mounted a radial ink control flap supported on an ink flow separation plate (not shown).

Referring now to FIG. 3 there is shown an alternative construction of doctor blade 11*a* which is provided with a backing or mount 25 which serves to protect the rear edge of the blade from direct contact with means for applying pressure to the blade. The backing or mount 25 may also serve to bear against a holder for the blade and provide therewith a fluid-tight seal to prevent leakage of ink upwardly past the blade 11*a*.

Referring now to FIG. 4 there is seen an alternative construction of holding and pressing means for the doctor blade, which could, for example, be inserted in place of the chamber 8 of the housing 6 shown in FIG. 1.

The blade 11*a* is provided at its upper edge with the backing or mount 25 seen in FIG. 3. The blade 11*a* is slidable vertically between opposed faces of two legs 26,27 of an elongated hollow chamber 28, and preferably forms a close fit therewith to avoid undue passage of ink. The mount 25 advantageously abuts in close sliding engagement against stepped inner faces of the legs 26,27 so as to enhance the fluid-tight fitting of the blade between the legs.

Within the hollow space of the chamber 28 there is provided a bag 29 which abuts at its lower narrowed portion 29*a* against the mount 25 of the blade. The bag may be permanently pressurized with a compressible fluid, or may be connected to a controllable source of pressurized fluid, and the pressure of the fluid in the bag acts to urge the blade downwardly, against the surface of the printing cylinder, with a pressure which is evenly exerted along the entire length of the blade, and such that the blade is urged towards the cylinder in a resilient manner rather than in a rigid manner.

Referring now to FIG. 5 there is shown a diagram illustrating how the doctor blade of FIG. 1 or of FIG. 5 could be arranged at an inclination counter to the rotation of the cylinder, instead of being radial thereto.

I claim:

1. In a doctor blade assembly, for inclusion in a printing machine having a frame structure and a printing cylinder rotatable in said frame structure, the improvement comprising:

(i) a mounting on said frame structure, including a pair of faces defining a blade guiding slot, (ii) a plane doctor blade positioned in said slot between said faces and slidably guided thereby for movement, when in use, parallel to its own plane towards and away from the printing cylinder, (iii) a backing member mounted on an edge of said doctor blade within said mounting, and (iv) fluid-pressure actuated loading means for said doctor blade including a bag for selectively receiving and containing pressurized resiliently-compressible fluid, said bag being disposed within said mounting and abutting said mounting and said backing member for urging said blade to move in said slot outwardly towards said printing cylinder.

2. A doctor blade assembly, as claimed in claim 1, wherein said mounting has means including a pair of opposed parallel surfaces bounding a space therein within which said backing member is disposed, said backing member forming a fluid-tight sliding seal with said parallel surfaces.

3. A doctor blade assembly, as claimed in claim 1, comprising conduit means on said mounting, said conduit means having an end portion terminating adjacent to a face of said doctor blade which is upstream when in use, said conduit means serving for passage of solvent liquid to said face of the doctor blade.

4. A doctor blade assembly as claimed in claim 1, and sliding joint means coupled to said mounting for carrying said mounting, when in use, on the frame structure of the printing machine so as to be movable to and fro in a direction which is substantially tangential to the surface of the printing cylinder.

5. The apparatus of claim 4, wherein said sliding joint means comprises an arm for securing on the frame structure of the printing machine, said arm including means defining a slot at a free end of said arm, and stem means carrying said mounting and positioned in said slot for movement along said slot.

* * * * *